US008908883B2

(12) United States Patent
Bai et al.

(10) Patent No.: US 8,908,883 B2
(45) Date of Patent: Dec. 9, 2014

(54) MICROPHONE ARRAY STRUCTURE ABLE TO REDUCE NOISE AND IMPROVE SPEECH QUALITY AND METHOD THEREOF

(75) Inventors: Mingsian R. Bai, Hsinchu (TW); Chun-Hung Chen, Taipei (TW)

(73) Assignee: National Chiao Tung University, Hsinchu (TW)

( * ) Notice: Subject to any disclaimer, the term of this patent is extended or adjusted under 35 U.S.C. 154(b) by 493 days.

(21) Appl. No.: 13/210,620

(22) Filed: Aug. 16, 2011

(65) Prior Publication Data

US 2012/0148069 A1 Jun. 14, 2012

(30) Foreign Application Priority Data

Dec. 14, 2010 (TW) ..... 099143712 A

(51) Int. Cl.
*G10L 21/0208* (2013.01)
*H04R 3/00* (2006.01)
*H04R 1/10* (2006.01)

(52) U.S. Cl.
CPC ..... *H04R 1/1083* (2013.01); *H04R 3/005* (2013.01); *H04R 2430/20* (2013.01)
USPC ..... 381/94.7; 381/94.1; 381/94.2; 381/94.3

(58) Field of Classification Search
USPC ..... 381/94.1, 94.2, 94.3, 94.7, 94.8
See application file for complete search history.

(56) References Cited

U.S. PATENT DOCUMENTS 4,323,731 A * 4/1982 Hershberger ..... 381/16
7,577,262 B2 8/2009 Kanamori et al.
2007/0073538 A1* 3/2007 Rifkin ..... 704/236
2009/0003622 A1* 1/2009 Burnett ..... 381/92
2009/0164212 A1 6/2009 Chan et al.
2010/0128897 A1* 5/2010 Saruwatari et al. ..... 381/94.3

FOREIGN PATENT DOCUMENTS

TW 535967 6/2003
TW 200939210 9/2009

OTHER PUBLICATIONS

Chanwoo Kim,M Kshitiz Kumar, Bhiksha Raj, Richard M. Stern, Signal Separation for Robust Speech Recognition Based on Phase Difference Information Obtained in the Frequency Domain, Interspeech-2009, pp. 2495-2498, Sep. 2009.

* cited by examiner

*Primary Examiner* — Duc Nguyen
*Assistant Examiner* — George Monikang
(74) *Attorney, Agent, or Firm* — Rosenberg, Klein & Lee

(57) ABSTRACT

The present invention discloses a microphone array structure able to reduce noise and improve speech quality and a method thereof. The method of the present invention comprises steps: using at least two microphone to receive at least two microphone signals each containing a noise signal and a speech signal; using FFT modules to transform the microphone signals into frequency-domain signals; calculating an included angle between a speech signal and a noise signal of the microphone signal, and selecting a phase difference estimation algorithm, a noise reduction algorithm or both to reduce noise according to the included angle; if the phase difference estimation algorithm is used, calculating phase difference of the microphone signals to obtain a time-space domain mask signal; and multiplying the mask signal and the average of the microphone signals to obtain the speech signals of the microphone signals. Thereby is eliminated noise and improve speech quality.

14 Claims, 2 Drawing Sheets

MICROPHONE ARRAY STRUCTURE ABLE TO REDUCE NOISE AND IMPROVE SPEECH QUALITY AND METHOD THEREOF

BACKGROUND OF THE INVENTION

1. Field of the Invention

The present invention relates to a technology for eliminating noise from a microphone, particularly to a microphone array structure able to reduce noise and improve speech quality and a method thereof.

2. Description of the Related Art

Microphones may pick up audio signals by a single-channel or dual-channel way. In a single-channel microphone system, the signal/noise ratio (SNR) thereof should be taken into consideration. In a dual-channel microphone system, microphones are arrayed to form a directional microphone system according to a beamforming technology. The directional microphone system is less sensitive to background noise but more sensitive to human voices. The directional microphone system is pointed to a person to receive his voices. However, the beam formed by two microphones is very large, and the directionality thereof is insufficient.

The common devices to reduce indoor or in-vehicle noises for mobile phones usually adopt numerous microphones, various filters and a great amount of matrix computation, which greatly increase the hardware cost of a mobile phone. Further, directionality of the conventional technologies, which have existed in products, patents and documents, is too low to effectively reduce noises without speech distortion.

Accordingly, the present invention proposes a microphone array structure able to reduce noise and improve speech quality and a method thereof to overcome the abovementioned problems. The technical contents and embodiments of the present invention are described in detail below.

SUMMARY OF THE INVENTION

The primary objective of the present invention is to provide a microphone array structure able to reduce noise and improve speech quality and a method thereof, wherein a phase difference estimation algorithm or a noise reduction algorithm is selected to reduce noise according to whether the angle included by a speech signal and a noise signal is a zero degree angle or a non-zero degree angle.

Another objective of the present invention is to provide a microphone array structure able to reduce noise and improve speech quality and a method thereof, wherein a GSS (Golden Section Search) algorithm is used to search for an optimal ITD (Interaural Time Difference) threshold, whereby the speech signals have the best quality at all angles.

To achieve the abovementioned objectives, the present invention proposes a microphone array structure able to reduce noise and improve speech quality, which comprises at least two microphones, at least two FFT (Fast Fourier Transform) modules, a processing module, a phase difference estimation module, a mask estimation module, and an IFFT (inverse-FFT)-OLA (overlap-and-add) module. The microphones receive at least two microphone signals each containing a noise signal and a speech signal. The FFT modules transform the microphone signals into frequency-domain signals. The processing module calculates an angle included by a noise signal and a speech signal. According to the included angle, the processing unit selects a combination of a phase difference estimation algorithm and a mask estimation algorithm, a noise reduction algorithm or both to reduce noise. The phase difference estimation module calculates the phase difference of the microphones and interaural time difference (ITD) and finds out optimized ITD thresholds corresponding to different included angles. The mask estimation module uses the threshold to obtain a mask signal according to a binary mask principle, and multiplies the mask signal and the average of the microphone signals to obtain the speech signals of the microphone signals. The IFFT-OLA module transforms the frequency-domain speech signals into time-domain signals.

The present invention also proposes a method for realizing a microphone array structure able to reduce noise and improve speech quality, which comprises steps: receiving at least two microphone signals and using FFT modules to transform the microphone signals into frequency-domain signals; calculating an angle included by a speech signal and a noise signal of the microphone signal, and selecting a combination of a phase difference estimation algorithm and a mask estimation algorithm, a noise reduction algorithm or both to reduce noise according to the included angle; calculating phase difference of the microphone signals and finding out interaural time difference (ITD); using a GSS (Golden Section Search) algorithm to search for optimized ITD thresholds corresponding to different included angles; using the threshold to obtain a mask signal according to a binary mask principle; multiplying the mask signal and the average of the microphone signals to obtain the speech signals of the microphone signals; and using an IFFT-OLA module to transform the frequency-domain speech signals into time-domain signals.

Below, the embodiments are described in detail to make easily understood the objectives, technical contents, characteristics and accomplishments of the present invention.

DETAILED DESCRIPTION OF THE INVENTION

The present invention proposes a microphone array structure able to reduce noise and improve speech quality and a method thereof, wherein phase difference of two microphone signals is used to obtain the mask of the microphone signals in a frequency domain and a time domain, whereby to reduce noise and improve speech quality.

Figure 1:
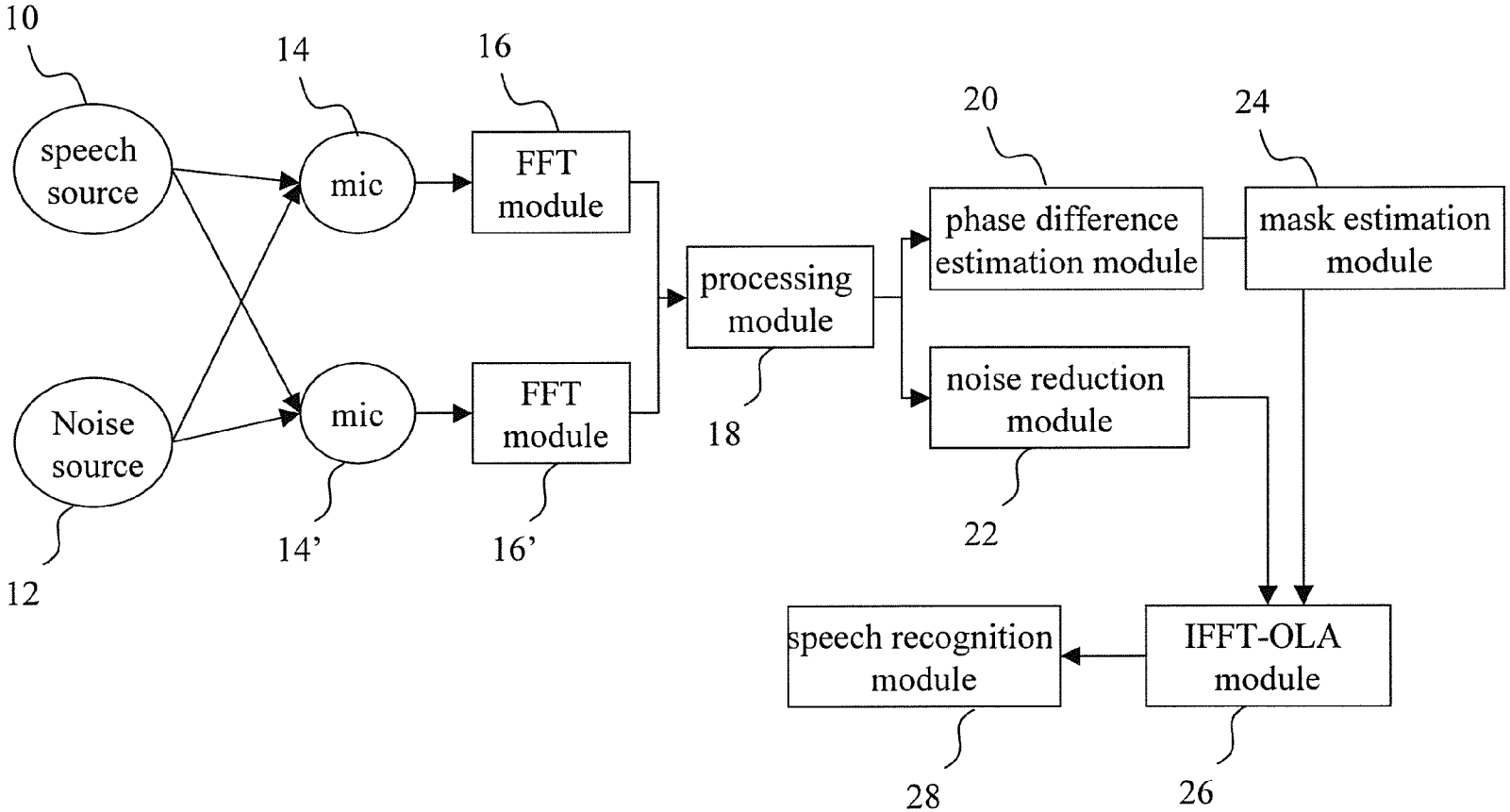
FIG. 1 is a diagram schematically showing a microphone array structure able to reduce noise and improve speech quality according to one embodiment of the present invention.

Refer to FIG. 1 a diagram schematically showing a microphone array structure able to reduce noise and improve speech quality according to one embodiment of the present invention. The microphone array structure of the present invention comprises at least two microphones 14 and 14', at least two FFT modules 16 and 16', a processing module 18, a phase difference estimation module 20, a noise reduction module 22, a mask estimation module 24, an IFFT (inverse-FFT)-OLA (overlap-and-add) module 26, and an automatic speech recognition module 28. A speech source 10 and a noise source 12 send out their signals, and the microphones 14 and 14' receive microphone signals that contain noise signals and speech signals. The FFT modules 16 and 16' transform the microphone signals into frequency-domain signals. The processing unit 18 calculates an angle included by a noise signal and a speech signal of the microphone signal, and selects a combination of a phase difference estimation algorithm and a mask estimation algorithm, or a noise reduction algorithm to reduce noise according to the included angle. The phase difference estimation module 20 calculates phase difference of the microphones 14 and 14' and interaural time difference (ITD) and finds out the optimized ITD thresholds corresponding to different included angles. The mask estimation module 24 uses the threshold to obtain a mask signal according to a binary mask principle, and multiplies the mask signal and the average of the microphone signals to obtain the speech signals of the microphone signals. The noise reduction module 22 uses a noise reduction algorithm to eliminate the noise signals from the microphone signals. The IFFT-OLA module 26 transforms the frequency-domain speech signals into time-domain signals. The automatic speech recognition module 28 receives the speech signals output by the IFFT-OLA module 26 and undertakes speech recognition.

Figure 2:
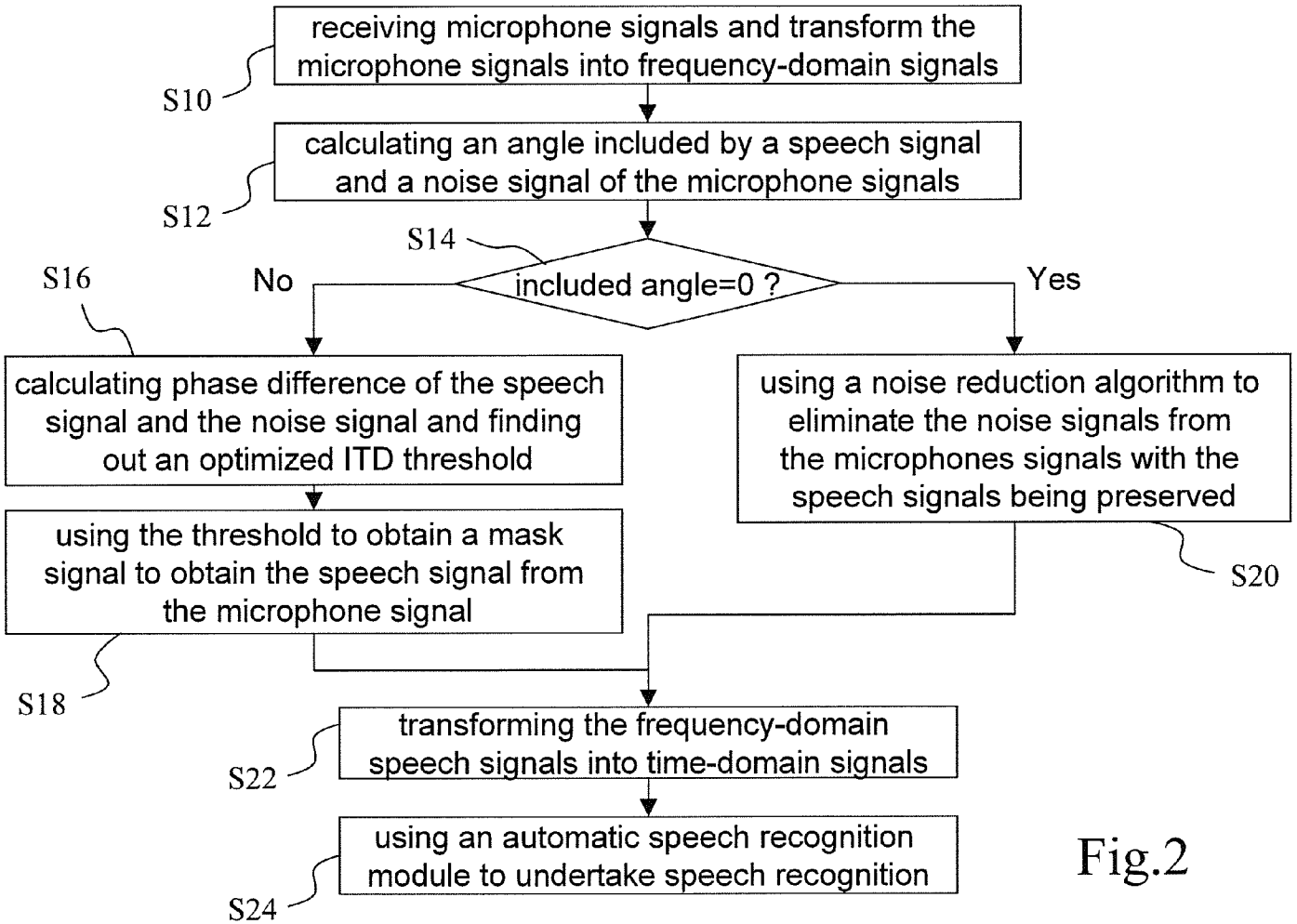
FIG. 2 is a flowchart of a method for realizing a microphone array structure able to reduce noise and improve speech quality according to one embodiment of the present invention.

Refer to FIG. 2 a flowchart of a method for realizing a microphone array structure able to reduce noise and improve speech quality according to one embodiment of the present invention. In Step S10, the noise signals and speech signals of two microphone signals are received by the microphones, and the microphone signals are transformed into frequency-domain signals via a Hamming window and FFT. The two microphone signals $P_1(k,l)$ and $P_2(k,l)$ are respectively expressed by Equation (1) and Equation (2):

$$P_1(k, l) = X(k, l) + \sum_{i=1}^{V} N_i(k, l) \tag{1}$$

$$P_2(k, l) = X(k, l) + \sum_{i=0}^{V} e^{-j\omega_k d_i(k,l)} N_i(k, l) \tag{2}$$

wherein (k, l) denotes the kth frequency and the lth frame, X a speech signal, $N_i$ the ith noise source, $P_m$ the signal received by the mth microphone, and N the length of FFT, and wherein $\omega_k=2\pi k/N$, and $0 \le k \le N/2-1$.

In Step S12, calculate the angle included by a noise signal and a speech signal of the microphone signal $P_1(k,l)$ or $P_2(k,l)$, i.e. the angle included by the speech source and the noise source, and select a combination of a phase difference estimation algorithm and a mask estimation algorithm, a noise reduction algorithm or both to reduce noise according to the included angle.

In Step S14, determine whether the included angle is a zero degree angle. If the included angle is a non-zero degree angle, the process proceeds to Step S16 to calculate phase difference of the noise signal and the speech signal and an ITD threshold.

Suppose that the speech signals are in the front of the microphones. Thus, ITD is zero. ITD of the noise signals from other directions are expressed by $d_i(k, l)$. ITD correlates with time and frequency. Suppose that a time-frequency domain signal $bin(k_j, l_j)$ is dominated by a strongest interference. Thus, Equations (1) and (2) can be simplified into Equations (3) and (4):

$$P_1(k_j,l_j) \approx N_n(k_j,l_j) \tag{3}$$

$$P_2(k_j,l_j) \approx e^{-j\omega_{kj} d_n(k_j,l_j)} N_n(k_j,l_j) \tag{4}$$

Thus, ITD can be obtained via calculating phase difference of the two microphones according to Equation (5):

$$|d_n(k_j, l_j)| \approx \frac{1}{|\omega_{k_j}|} \min_r |\angle P_1(k_j, l_j) - \angle P_2(k_j, l_j) - 2\pi r| \tag{5}$$

The ITD threshold is needed in Step S18. Thus, a method, such as a GSS (Golden Section Search) algorithm, is used to search for the optimized ITD thresholds $\tau$ corresponding to different included angles in Step S16. Suppose that a function f(x) is continuous and has only a minimum in [a, b]. Select Point c and Point d from [a, b]. Suppose that $$\frac{\overline{ca}}{\overline{ba}} = \frac{3-\sqrt{5}}{2} \tag{9}$$

wherein d is a symmetric point of c in Line Segment $\overline{ab}$. Compare f(c) and f(d). If f(c)<f(d), the searched range becomes [a, d]. If f(c)>f(d), the searched range becomes [c, b]. Next, select a point in the new searched range, and compare the functional values of the point and a point symmetric to the point. Repeat the abovementioned process to keep on decreasing size of the searched range. When the range has been decreased to an acceptable size, the function value f(x) is regarded as the minimum function value in [a, b]. According to Taylor's theorem, when x approaches $x_m$, the function value of x approximates $$f(x) \approx f(x_m) + \tfrac{1}{2} f''(x_m)(x-x_m)^2 \tag{10}$$

If x approaches $x_m$ sufficiently, the rear second derivative item is very small and can be neglected. In such a case, Equation (10) can be expressed by Equation (11):

$$\tfrac{1}{2} f''(x_m)(x-x_m)^2 < \epsilon |f(x_m)| \tag{11}$$

wherein $\epsilon$ is equal to $10^{-3}$. Suppose that the parameters of the function of the GSS algorithm include the speech distortion, noise elimination ratio, quality of the total speech signals. $\tau$ can be expressed by Equation (12):

$$\tau = -0.000056\theta^2 + 0.0108\theta - 0.0575 \tag{12}$$

wherein $\theta$ is an angle included by a speech signal and a noise signal. The $\tau$ values obtained from Equation (12) can make the processed signals have the best speech quality.

After the optimized ITD thresholds have been obtained, the process proceeds to Step S18, and a binary mask principle is used to work out a microphone mask signal according to Equation (6):

$$B(k_j, l_j) = \begin{cases} 1, & \text{if } |d_n(k_j, l_j)| \le \tau \\ 0.01, & \text{otherwise} \end{cases} \tag{6}$$

wherein only the signals having ITD smaller than $\tau$ are regarded as target speech signals.

The resultant speech signal S(k,l) can be obtained via multiplying the mask signal $B(k_j,l_j)$ and the average of the two microphone signals $\overline{P}(k,l)$. The average of the two microphone signals $\overline{P}(k,l)$ and the resultant speech signal S(k,l) are respectively expressed by Equation (7) and Equation (8):

$$\overline{P}(k, l) = \frac{1}{2}\{P_1(k, l) + P_2(k, l)\} \tag{7}$$

$$S(k,l) = B(k,l)\overline{P}(k,l) \tag{8}$$

After the speech signals are separated from the noise signals in Step S18, the process proceeds to Step S22, and the IFFT (inverse-FFT) and OLA (overlap-and-add) methods are used to convert the frequency-domain speech signals into time-domain signals, and the time-domain signals are output. Then, the process proceeds to Step S24, and the automatic speech recognition module recognizes the output speech signals.

If the included angle is determined to be a non-zero degree angle in Step S14, the process proceeds to Step S20, and a noise reduction algorithm is used to eliminate noise signals from microphones signals with speech signals being preserved. Next, the process proceeds to Step S22, and the IFFT and OLA methods are used to convert the frequency-domain speech signals into time-domain signals, and the time-domain signals are output. Then, the process proceeds to Step S24, and the automatic speech recognition module recognizes the output speech signals.

Summarily, the method of the present invention determines whether the angle included by a speech signal and a noise signal is a zero degree angle. If the included angle is a zero degree angle, a noise reduction algorithm is used to reduce noise. If the included angle is a non-zero degree angle, a phase difference estimation algorithm is used to reduce noise. The phase difference estimation algorithm provides optimized ITD thresholds to attain the best noise reduction effect and the best speech quality at all included angles.

The embodiments described above are only to exemplify the present invention but not to limit the scope of the present invention. Any equivalent variation or modification according to the spirit of the present invention is to be also included within the scope of the present invention.

What is claimed is:

1. A microphone array structure able to reduce noise and improve speech quality, comprising:

at least two microphones respectively receiving at least two microphone signals each containing a noise signal and a speech signal;

at least two FFT (Fast Fourier Transform) modules transforming said microphone signals into frequency-domain signals;

a processing unit calculating an included angle between said noise signal and said speech signal of said microphone signals and, selectively executing a spatial noise masking including a combination of a phase difference estimation with a masking estimation responsive to a non-zero value of said included angle, and executing a noise reduction to reduce noise responsive to a zero value of said included angle;

a phase difference estimation module calculating phase difference and interaural time difference (ITD) of said microphone signals and identifying optimized ITD thresholds corresponding to said included angles, said thresholds are identified with a GSS (Golden Section Search) module;

a mask estimation module using said thresholds to obtain a mask signal according to a binary mask, and multiplying said mask signal and an average of said microphone signals to obtain said speech signal of said microphone signal; and an IFFT (inverse-FFT)-OLA (overlap-and-add) module transforming said frequency-domain signals into time-domain signals;

wherein said GSS module selects two points from a continuous range; said GSS module then compares function values of said two points and decreases size of said continuous range; and said GSS module then selects two additional points and compares function values thereof to continue decreasing size of said continuous range until a minimum function value is identified in said continuous range.

2. The microphone array structure able to reduce noise and improve speech quality according to claim 1 further comprising a noise reduction module using said noise reduction to eliminate noise when said included angle is a zero-degree angle.

3. The microphone array structure able to reduce noise and improve speech quality according to claim 1, wherein said phase difference estimation module calculates said phase difference and said interaural time difference when said included angle is greater than zero.

4. The microphone array structure able to reduce noise and improve speech quality according to claim 2, wherein both said noise reduction module and said phase difference estimation module are connected with said processing unit.

5. The microphone array structure able to reduce noise and improve speech quality according to claim 1, wherein said IFFT-OLA module includes an IFFT (inverse-FFT) module and an OLA (overlap-and-add) module.

6. The microphone array structure able to reduce noise and improve speech quality according to claim 1, wherein when a source of said speech signal is in front of said microphones, said interaural time difference is zero.

7. The microphone array structure able to reduce noise and improve speech quality according to claim 1 further comprising an automatic speech recognition module receiving speech signals output by said IFFT-OLA module and undertaking speech recognition.

8. A method for realizing a microphone array structure able to reduce noise and improve speech quality, comprising steps:

receiving at least two microphone signals and using at least two FFT modules to respectively transform said microphone signals into frequency-domain signals;

calculating an included angle between a noise signal and a speech signal of said microphone signals, selectively executing at least one of a combination of a phase difference estimation with a mask estimation, and a noise reduction according to said included angle to eliminate said noise signals from said microphone signals with said speech signals being preserved; and using an IFFT (inverse-FFT)-OLA (overlap-and-add) module to transform said speech signals into a time-domain signal, wherein the phase difference estimation includes a GSS (Golden Section Search) executed to identify an optimized interaural time difference (ITD) threshold corresponding to said included angle, wherein said GSS includes steps: arbitrarily selecting two points from a continuous range; comparing function values of said two points and decreasing size of said continuous range; and repeating steps of arbitrarily selecting two points and comparing function values thereof to iteratively decrease size of said continuous range until a minimum function value is found in said continuous range.

9. The method for realizing a microphone array structure able to reduce noise and improve speech quality according to claim 8, wherein said IFFT-OLA module transforms said speech signals of frequency domain into a signal of time domain.

10. The method for realizing a microphone array structure able to reduce noise and improve speech quality according to claim 8, wherein when a source of said speech signal is in front of said microphones, said interaural time difference is zero.

11. The method for realizing a microphone array structure able to reduce noise and improve speech quality according to claim 8, wherein said noise reduction is used to eliminate said noise signal when said included angle is a zero-degree angle.

12. The method for realizing a microphone array structure able to reduce noise and improve speech quality according to claim 8, wherein said minimum function value and a Taylor's theorem are used to identify said threshold.

13. The method for realizing a microphone array structure able to reduce noise and improve speech quality according to claim 8, wherein said microphone signal is regarded as said speech signal when said interaural time difference is smaller than said threshold.

14. The method for realizing a microphone array structure able to reduce noise and improve speech quality according to claim 8, further comprising an automatic speech recognition module receiving speech signals output by said IFFT-OLA module and undertaking speech recognition.

* * * * *